US007884740B2

(12) United States Patent
Tzuang et al.

(10) Patent No.: US 7,884,740 B2
(45) Date of Patent: Feb. 8, 2011

(54) MULTI-LANE VEHICLE DETECTION APPARATUS

(75) Inventors: Ching-Kuang C. Tzuang, Taipei (TW); Chi-Ho Chang, Taipei County (TW)

(73) Assignee: National Chiao Tung University, Hsinchu (TW)

( * ) Notice: Subject to any disclaimer, the term of this patent is extended or adjusted under 35 U.S.C. 154(b) by 419 days.

(21) Appl. No.: 12/078,236

(22) Filed: Mar. 28, 2008

(65) Prior Publication Data

US 2009/0243890 A1 Oct. 1, 2009

(51) Int. Cl.
*G08G 1/065* (2006.01)
*G08G 1/00* (2006.01)
*G08G 1/01* (2006.01)

(52) U.S. Cl. ..... 340/934; 340/933; 340/936

(58) Field of Classification Search ..... 340/933, 340/934, 936

See application file for complete search history.

(56) References Cited

U.S. PATENT DOCUMENTS 5,793,491 A * 8/1998 Wangler et al. ..... 356/613
5,798,983 A * 8/1998 Kuhn et al. ..... 367/135
6,104,250 A * 8/2000 Eckersten et al. ..... 331/2
6,556,916 B2 * 4/2003 Waite et al. ..... 701/117
6,590,236 B1 * 7/2003 El-Zein et al. ..... 257/201
7,427,930 B2 * 9/2008 Arnold et al. ..... 340/933
7,474,259 B2 * 1/2009 Manor ..... 342/174
2004/0075582 A1 * 4/2004 Bergan et al. ..... 340/936
2006/0132350 A1 * 6/2006 Boltovets et al. ..... 342/70
2007/0085727 A1 * 4/2007 Backes et al. ..... 342/68
2007/0222639 A1 * 9/2007 Giles et al. ..... 340/907

OTHER PUBLICATIONS

RTMS User Manual, EIS Electronic Integrated Systems Inc. Issue 3.2, Apr. 2004.*

* cited by examiner

*Primary Examiner*—Benjamin C Lee
*Assistant Examiner*—Andrew Bee
(74) *Attorney, Agent, or Firm*—Bacon & Thomas, PLLC

(57) ABSTRACT

A vehicle detection apparatus adopting microwave sensing schemes for performing the multi-lane vehicle detection is provided in the present invention. According to the present invention, the signal-to-noise ratio (SNR) of the detected reflecting wave is varied within an inconsiderable range so that the provided apparatus may exhibit a unique property which is adoptable for the multi-lane vehicle detection and the precision is unachievable by the existing detectors.

3 Claims, 6 Drawing Sheets

MULTI-LANE VEHICLE DETECTION APPARATUS

FIELD OF THE INVENTION

The present invention relates to a vehicle detecting apparatus, and more particularly to a microwave radar vehicle detecting apparatus.

BACKGROUND OF THE INVENTION

The vehicle detecting apparatus is installed at the roadside to collect the traffic information for instantaneously determining the traffic situation and monitoring the vehicle transportation for the traffic management. With the combination of the well-designed automatic assessment model, the vehicle detecting apparatus is able to provide the desired traffic information.

Regarding the existing vehicle detecting apparatuses, the loop-typed detector is commonly applied in the present transportation management system(TMS). The variation of electrical induction may occur and may be detected while the target vehicle passes the metallic loops of the detector that is arranged under the ground, and thereby the traffic flow as well as the vehicle occupancy would be obtainable. The speed and length of the vehicle are determined with the duration of passing two adjacent loops, and therewith the vehicle classification is further determined. Such detecting apparatus, however, is disadvantageous since the lanes need to be closed while the detecting apparatus is maintained, which causes a great inconvenience for the transportation management.

With respect to further detecting schemes, the use of Doppler radar for vehicle detection results in relatively accurate information for the vehicle speed. In order to obtain the maximum echo power, however, the wave transmitted by such radar exhibits the characteristic of uni-direction, and accordingly each Doppler radar is merely adoptable for the single-lane vehicle detection. The echo power of the Doppler radar may vary with the distance between the detecting apparatus and the target vehicle if such radar is applied for the multi-lane vehicle detection, so that the detection accuracy would be affected thereby. For this reason, it needs to arrange a dedicated detecting apparatus for each respective traffic lane if the traffic information for multiple lanes is desired, and such arrangement also causes extremely high set-up and maintain costs.

Moreover, the detecting apparatus using the Doppler radar is only suitable for speed detection, which fails in obtaining some further traffic parameters, such as the vehicle classification, the occupancy and the density, that are desired for the transportation management.

On the other hand, the remote traffic microwave detector adopting the frequency-modulation continuous-wave (FMCW) scheme is regarded as a generally cost-effective solution. Such detecting apparatus transmits FMCW signals with a fixed sector-shaped beam at a low power level, and the microwave beam may form an invisible ellipse trace above the road surface. In this case, the signal reflecting from any object will be transmitted to the detecting apparatus for the target detection and distance determination. It is believed that such apparatus is of great potential in the vehicle detection application.

Regarding the existing microwave detecting apparatus, the intermediate-frequency and digital signal processor thereof needs to carry out the post-stage signal process relating to the respective echo power of the signal that is reflecting from the targets of different distances, so as to determine the relevant traffic parameters. In this case, the functions of such detecting apparatus are still limited, and is disadvantageous in the relatively high cost due to the different designs thereof for the post-stage signal process.

According to the statement above, a vehicle detecting apparatus on different lanes at low cost is in need.

SUMMARY OF THE INVENTION

In accordance with a first aspect of the present invention, a detecting apparatus for multi-lane vehicle detection is provided. The provided detecting apparatus includes a radio-frequency transceiving unit having a signal input and a s signal output and generating a difference-frequency signal, at least two antennas of leakage-wave mode arranged closely to each other and coupled to the signal input and the signal output respectively, and an intermediate-frequency and digital signal processing unit coupled to the radio-frequency transceiving unit and generating at least a traffic parameter corresponding to at least a lane in response to the difference-frequency signal.

In accordance with the mentioned aspect, the antennas are configured to receive a microwave signal having a signal-to-noise ratio reflecting from a target where the signal-to-noise ratio is varied from 0 to 32 dB, and thereby the detecting apparatus is operable in the multi-lane vehicle detection.

Preferably, the antennas are configured at a position to receive the microwave signal at an elevation angle, and the detecting apparatus further includes an adjusting device coupled to the antennas for adjusting the position or the elevation angle.

Preferably, the radio-frequency transceiving unit further includes a voltage controlled oscillator, a buffer amplifier coupled to the voltage controlled oscillator, a power divider coupled to the buffer amplifier, a first driving amplifier and a second driving amplifier respectively coupled to the power divider at a first end and a second end thereof, a mixer coupled to the first driving amplifier, and a low-noise amplifier coupled to the mixer.

Preferably, the voltage controlled oscillator, the buffer amplifier, the power divider, the first and second driving amplifiers, the mixer and the low-noise amplifier are integrated into a chip.

Preferably, the antennas are spaced from each other at a distance of less than 5 mm and have an isolation value of at least 40 dB.

Preferably, the traffic parameter is one selected from a group consisting of a vehicle speed, a vehicle classification, an occupancy, a density and a flow.

In accordance with a second aspect of the present invention, an embedded detecting apparatus for multi-lane vehicle detection is provided. The provided embedded detecting apparatus includes a system-on-chip having a radio-frequency transceiving module for generating a frequency-modulation continuous-wave signal integrated thereon, an antenna module coupled to the system-on-chip, and an intermediate-frequency and digital processing unit coupled to the radio-frequency transceiving module and generating a difference-frequency signal corresponding to at least a traffic parameter of at least a lane in response to the frequency-modulation continuous-wave signal.

In accordance with the mentioned aspect, the antenna module is configured to receive a microwave signal having a signal-to-noise ratio reflecting from a target where said signal-to-noise ratio is varied from 0 to 32 dB, and thereby the embedded detecting apparatus is operable in the multi-lane vehicle detection.

Preferably, the antenna module includes at least a pair of antennas of leakage-wave mode.

Preferably, the antennas are configured at a position to receive the microwave signal at an elevation angle, and the embedded detecting apparatus further includes an adjusting device coupled to the antennas for adjusting one of the position and the elevation angle.

Preferably, the antennas are spaced from each other at a distance of less than 5 mm and have an isolation value of at least 40 dB.

Preferably, the traffic parameter is one selected from a group consisting of a vehicle speed, a vehicle classification, an occupancy, a density and a flow.

BRIEF DESCRIPTION OF THE DRAWINGS

The above objects and advantages of the present invention will become more readily apparent to those ordinarily skilled in the art after reviewing the following detailed descriptions and accompanying drawings, in which.

DETAILED DESCRIPTION OF THE PREFERRED EMBODIMENT

The present invention will now be described more specifically with reference to the following embodiments. It should be noted that the following descriptions of preferred embodiments of this invention are presented herein for purposes of illustration and description only; it is not intended to be exhaustive or to be limited to the precise form disclosed.

Figure 1:
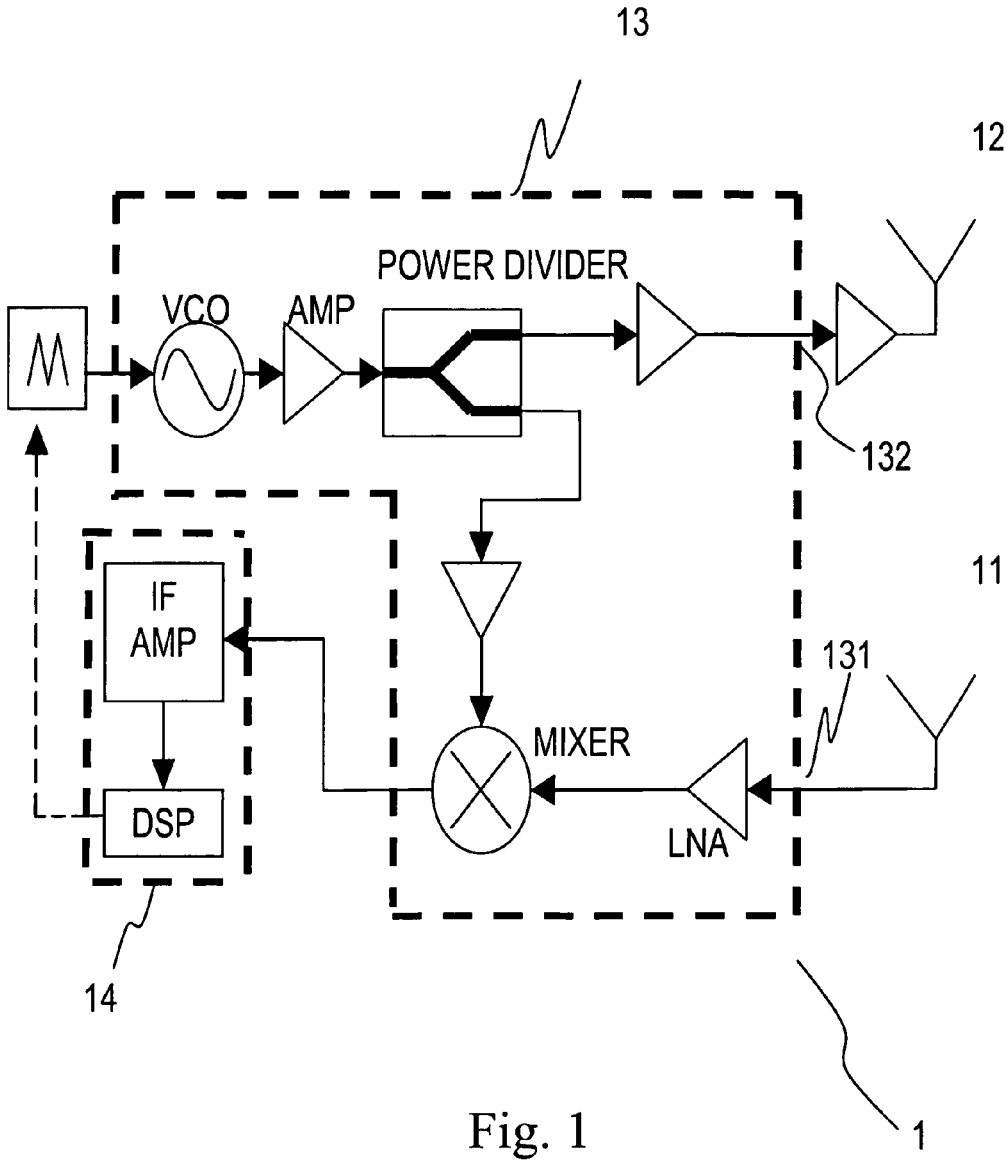
FIG. 1 is a block diagram showing the microwave vehicle detecting apparatus in accordance with a preferred embodiment of the present invention.

Please refer to FIG. 1, which is a block diagram showing the microwave vehicle detecting apparatus in accordance with a preferred embodiment of the present invention. The microwave vehicle detecting apparatus 1 of the present invention adopts the frequency-modulation continuous-wave (FMCW) for carrying out the detection of traffic parameters for multiple lanes. The microwave vehicle detecting apparatus 1 is mainly constructed by a receiving antenna array 11 and a transmitting antenna array 12 which are respectively coupled to the signal input 131 and signal output 132 of the radio-frequency transceiving unit 13. Moreover, the microwave vehicle detecting apparatus 1 further includes an intermediate-frequency and digital signal processing unit 14 which is coupled to the radio-frequency transceiving unit 13 for the real assessment of range measurement, so as to produce a traffic parameter such as the vehicle speed, the vehicle classification, the vehicle occupancy, the density and the flow in response to the difference-frequency signal generated thereby.

Figure 2:
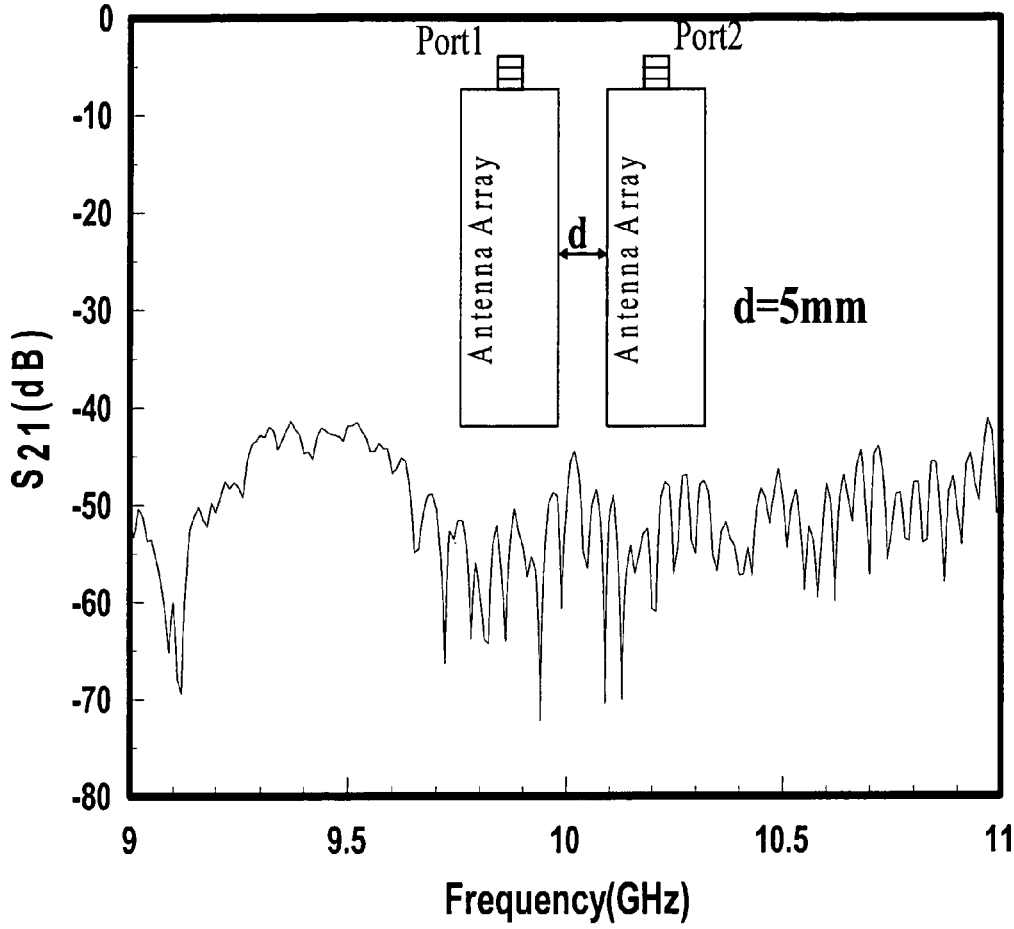
FIG. 2 is a diagram illustrating the electromagnetic coupling ($S_{21}$) between the receiving antenna array and the transmitting antenna array of the microwave vehicle detecting apparatus of the present invention, which is varied with the frequency.

According to the present invention, the receiving antenna array 11 and the transmitting antenna array 12 are arranged closely to each other so that the dimension of microwave vehicle detecting apparatus 1 is possibly reduced. In accordance with a preferred embodiment of the present invention, the distance d between the receiving antenna array 11 and the transmitting antenna array 12 is less than 5 mm, while the isolation of the two antenna arrays at various frequencies, from 9 to 11 GHz for example, still maintains at 40 dB or even higher. The effect of near-field coupling could be consequently eliminated, as shown in FIG. 2. With reference to FIG. 2 in which the measured coupling of the receiving antenna array 11 with respect to the transmitting antenna array 12, $S_{21}$, is illustrated, it is believed that the effect of near-field coupling of the two antenna arrays is reduced with the decreased measured coupling thereof, and an improved isolation thereof is achieved.

Figure 3:
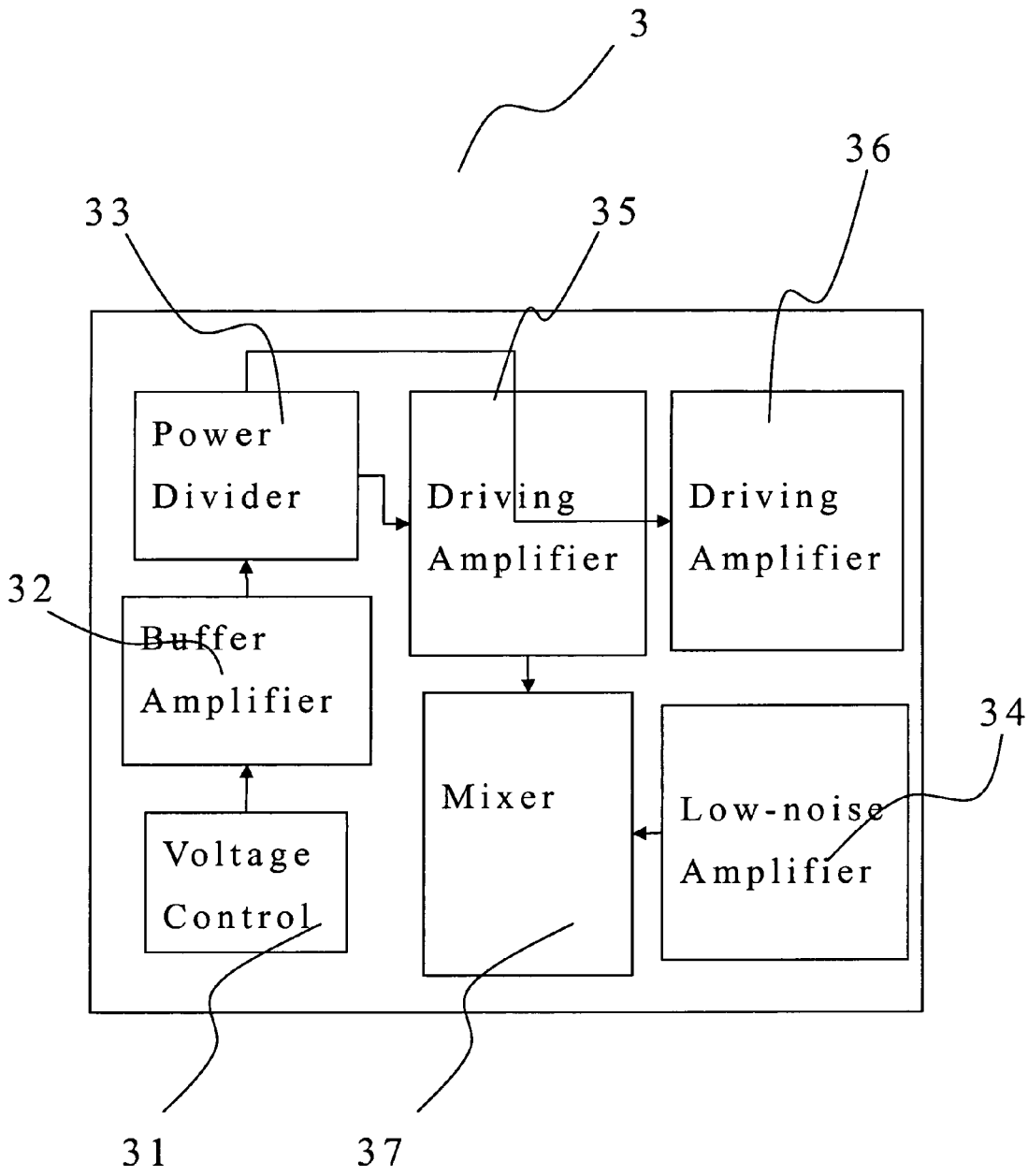
FIG. 3 is a photo revealing the layout of the system-on-chip of the microwave vehicle detecting apparatus of the present invention.

Regarding the above-mentioned embodiment, the radio-frequency transceiving unit 13 is integrated into a standard 0.18 μm one-poly six-metal (1P6M) complementary metal-oxide semiconductor (CMOS) fully integrated system-on-chip. Please refer to FIG. 3, in which the layout of such a system-on-chip 3 developed by the applicant of the present invention is revealed. The system-on-chip 3 of the microwave vehicle detecting apparatus according to the present invention is consisting of the voltage controlled oscillator (VCO) 31, the buffer amplifier 32, the power divider 33, the low-noise amplifier (LNA) 34, two driving amplifier 35 and 36, and the mixer 37 integrated thereon, so as to carry out most procedures of radio-frequency signal processing desired for the signal detection. Furthermore, a power amplifier is also externally configured for enhancing the power of the signal output by the system-on-chip 3.

In accordance with a preferred embodiment of the present invention, the system-on-chip 3 is designed by using the so called complementary-conducting-strip transmission line (CCS TL) technology, and all building blocks as well as the inter-stage connections of the system-on-chip 3 are realized with the CCS TLs in order to maximize the attainable isolation required by the FMCW detecting apparatus. Preferably, the power divider 33, which is located on the upper left corner of the system-on-chip 3, is constructed by two 70.7Ω CCS TLs and an isolation resistor of 100Ω shunting two output ports respectively coupled to the two driving amplifiers (Amp_LO) 35 and (Amp_TX) 36 through a CCS TL with a length of 670 μm and a further CCS TL with a length of 320 μm.

According to the present invention, the triangular wave, which is generated by the external digital signal processing unit, is fed to the on-chip VCO 31. The transmitted signal is then split into two paths using an integrated two-way equal-split power divider, i.e. the power divider 33, and fed to the driving amplifiers 35 and 36 through the two output ports.

Figure 4:
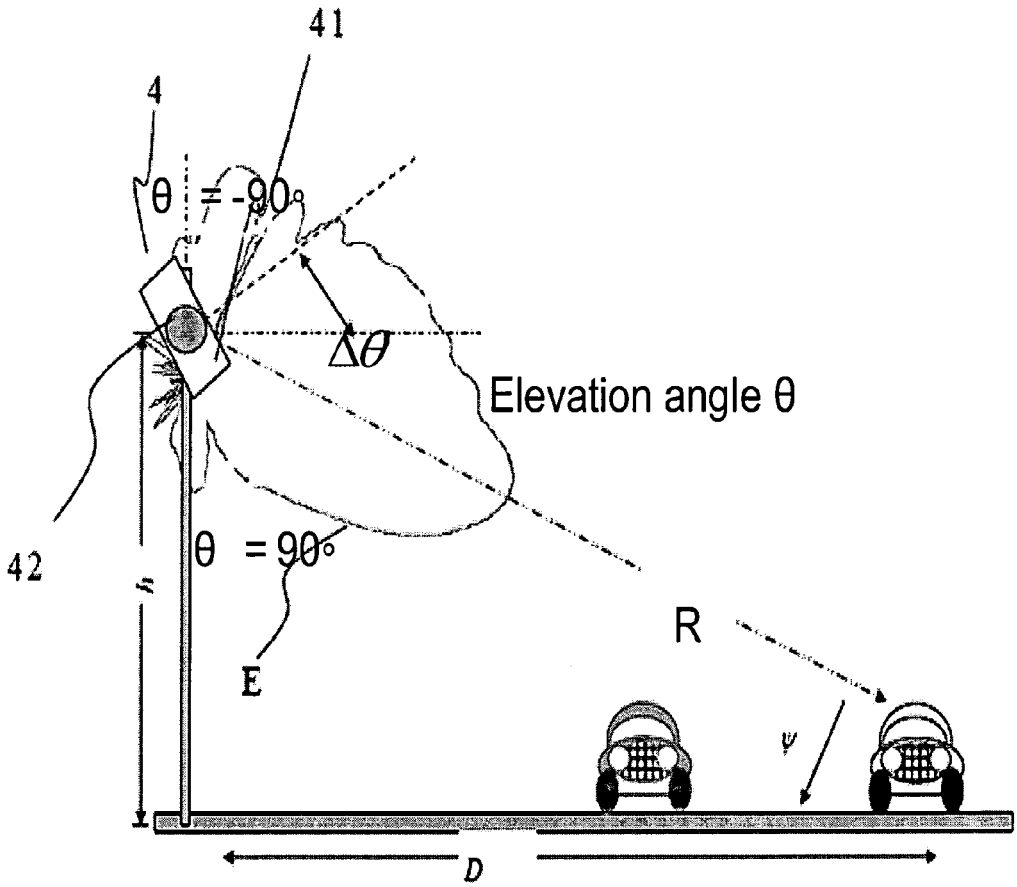
FIG. 4 is a diagram schematically illustrating the setups of the detecting apparatus for multi-lane vehicle detection of the present invention.

With reference to FIG. 4, the setups of the detecting apparatus for multi-lane vehicle detection of the present invention are schematically illustrated. The detecting apparatus 4 adopting the microwave scheme as mentioned for performing the multi-lane vehicle detection is a road-side unit, and is installed above the ground at a certain height, denoted by h. The vehicle occupancy in multiple lanes is detected by performing a range measurement with the detecting apparatus according to the present invention. The distance, which is equal to the total width of the multiple lanes, is denoted by D in FIG. 4, and represents the maximum coverage of the detecting apparatus, wherein the field of the antennas of the detecting apparatus is indicated by E. In the present embodiment, the microwave vehicle detecting apparatus is installed in an enclosure 41, and therein a system-on-chip of radio-frequency transceiving unit as well as an intermediate-frequency and digital signal processing unit are also integrated. Two antenna arrays are arranged on the top surface of the enclosure 41 and are covered by a radome (not shown). As shown in FIG. 4, the H-plane of the antenna array is orthogonal to the traffic lane, and slanted with an elevation angle θ by an adjusting device 42 coupled to the antenna array. The elevation angle θ as well as the height h are adjustable by the adjusting device 42 such that the Doppler effect caused by the moving vehicle could be suppressed and the signal-to-noise ration (SNR) of the signal obtained from each lane could be regulated. In this embodiment, the height h of the detecting apparatus and the distance D between the detecting apparatus and the target vehicle are respectively 3 m and 30 m. Preferably, the detecting apparatus according to the present invention is constructed by the antenna array of leakage-wave mode, where the measurement result thereof is shown in FIG. 5.

Figure 5:
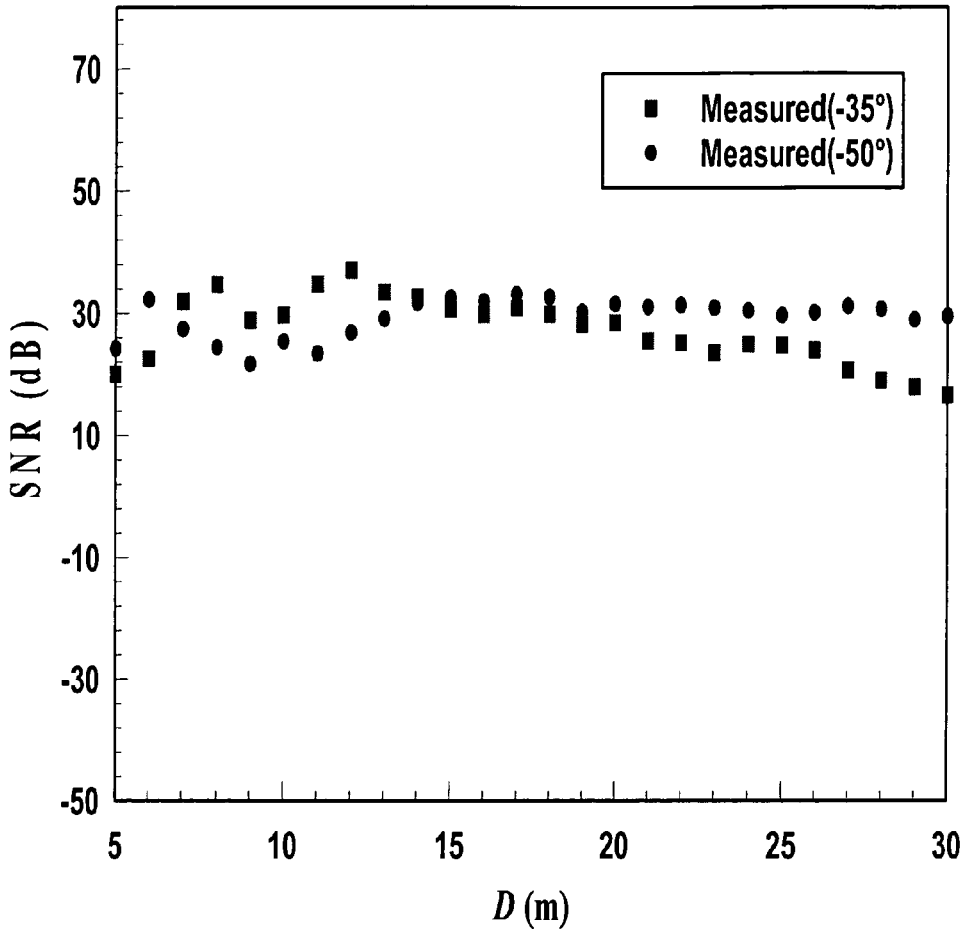
FIG. 5 is a diagram illustrating the signal-to-noise ratio (SNR) of the detecting apparatus of FIG. 4 at different elevation angles, which is varied with the distance D between the detecting apparatus and the target vehicle.

Please refer to FIG. 5 illustrating the SNR of the detecting apparatus of FIG. 4 at elevation angles of 35° and 50°, which is varied with the distance D between the detecting apparatus and the target vehicle. As shown in FIG. 5, while the detecting apparatus for multi-lane vehicle detection according to the present invention receives the microwave signals from the target vehicles at a distance ranged from 5 m to 30 m in which the distance D of 30 m equals the sum of widths of 6 to 8 lanes, the SNR of the microwave signal reflecting from the target at different distances is varied in a range between 28 dB and 34 dB owing to the specific design of the antenna of leakage-wave mode.

Figure 6:
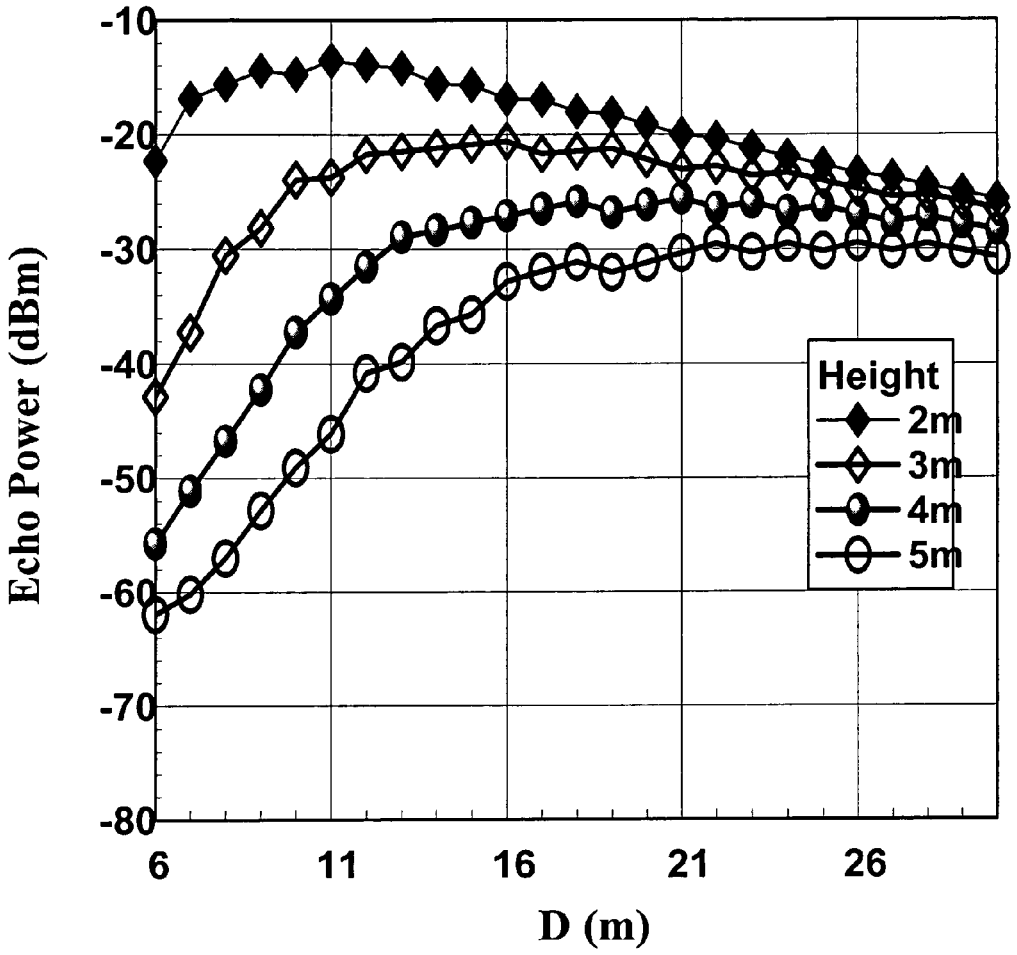
FIG. 6 is a diagram illustrating the echo power of the detecting apparatus of FIG. 4 at different heights, which is varied with the distance D between the detecting apparatus and the target vehicle.

Furthermore, with reference to FIG. 6, the echo power of the detecting apparatus of FIG. 4 at different heights, which is varied with the distance D between the detecting apparatus and the target vehicle, is illustrated where curves (A), (B), (C) and (D) indicate the measurement results for h of 2, 3, 4 and 5 m, respectively. It is shown in FIG. 6 that the maximum of echo power, approximately 30 to 35 dB, occurs when the distance D between the detecting apparatus and the target vehicle equals to 30 m and the height equals to 5 m. Consequently, the echo power resulting from the detecting apparatus according to the present invention is varied within a substantially inconsiderable range, e.g. within a range of 32 dB typically.

In other words, by applying the detecting apparatus of the present invention for performing the multi-lane vehicle detection, the echo power would not substantially varied with the different distances between the respective target vehicle and the detecting apparatus, and that is, the detection accuracy of the detecting apparatus would not affected thereby. In this case, the post-stage process involving the algorithm and actual design for the intermediate-frequency and digital signal processing unit could be advantageously simplified so that the traffic parameters including the vehicle speed, the vehicle classification, the occupancy, the density and the flow could be obtained in a cost-effective manner. As a result, the detecting apparatus according to the present invention is operable in obtaining the traffic data from multiple lanes with a relatively high degree of accuracy.

According to the present invention, a novel microwave detecting apparatus constructed by the radio-frequency (RF) module or system-on-chip of CMOS RF signal transceiving unit, two planar antenna arrays of leakage-wave mode and the intermediate-frequency and digital signal processing unit is provided and applied in a traffic management system (TMS) for multi-lane vehicle detection. By the detecting apparatus of the present invention, the echo power and the SNR thereof are varied within a substantially inconsiderable range while the distance between the target vehicle and the detecting apparatus is changed. As a result, the provided detecting apparatus still exhibits a stable ability in obtaining a high degree of accuracy while detecting the vehicles in different lanes, so as to realize the multi-lane vehicle detection that is unachievable by the conventional detecting apparatus in this art. Furthermore, the detecting apparatus of the present invention adopts the dual antennas of leakage-wave mode for signal receiving and transmitting. In comparison with the conventional one of single-antenna configuration, the dual-antennas design according to the present invention is advantageous in the compact installation with an excellent isolation. Additionally, the circulator which connects the output of the transmitter, the antenna and the input of the transceiver is eliminated according to the present invention on one hand, and on the other, the present detecting apparatus could be fabricated with the print circuit board (PCB) integration. Therefore, it is believed that the present invention is advantageous in the reduced dimension, improved detection accuracy and cost-effect in fabrication.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims, which are to be accorded with the broadest interpretation so as to encompass all such modifications and similar structures. Therefore, the above description and illustration should not be taken as limiting the scope of the present invention which is defined by the appended claims.

What is claimed is:

1. A microwave vehicle detecting apparatus having a receiving antenna array and a transmitting antenna array with signal-to-noise ratio varied from 28 dB to 34 dB for multi-lane vehicle detection at a respective distance ranged from 5 m to 30 m to the multiple lanes, comprising:

a radio-frequency transceiving unit having a signal input and a signal output and generating a difference-frequency signal therefrom;

a receiving antenna array and a transmitting antenna array, wherein said receiving antenna array and said transmitting antenna array are isolated by a value of at least 40 dB, and the receiving array receives a microwave signal having a signal-to-noise ratio reflecting from a target where said signal-to-noise ratio being varied from 28 dB to 34 dB corresponding to the multiple lanes, and the antenna arrays being configured at a position for the receive antenna array to receive said microwave signal at an elevation angle and being spaced from each other at a distance of less than 5 mm and coupled to said signal input and said signal output respectively;

an adjusting device coupled to said receiving antenna array and said transmitting antenna array for adjusting one of said position and said elevation angle to achieve the signal-to-noise ratio; and an intermediate-frequency and digital signal processing unit for a real assessment of range measurement coupled to said radio-frequency transceiving unit and generating at least a traffic parameter corresponding to at least a lane in response to said difference-frequency signal, wherein said traffic parameter being selected from a group consisting of a vehicle speed, a vehicle classification, an occupancy, a density and a flow; thereby said microwave vehicle detecting apparatus being operable for multi-lane vehicle detection.

2. The microwave vehicle detecting apparatus according to claim 1, wherein said radio-frequency transceiving unit made by being integrated into a standard 0.18 μm one-poly six-metal (1P6M) complementary metal-oxide semiconductor (CMOS) as system-on-chip, comprises:

a voltage controlled oscillator;

a buffer amplifier coupled to said voltage controlled oscillator;

a power divider coupled to said buffer amplifier;

a first driving amplifier and a second driving amplifier respectively coupled to said power divider at a first end and a second end thereof;

a mixer coupled to said first driving amplifier; and a low-noise amplifier coupled to said mixer, wherein said voltage controlled oscillator, said buffer amplifier, said power divider, said first and second driving amplifiers, said mixer and said low-noise amplifier are integrated into the chip.

3. A microwave vehicle detecting apparatus having a receiving antenna array and a transmitting antenna array with signal-to-noise ratio varied from 28 dB to 34 dB for multi-lane vehicle detection at a respective distance ranged from 5 m to 30 m to the multiple lanes, comprising:

a radio-frequency transceiving unit, wherein said radio-frequency transceiving unit made by being integrated into a standard 0.18 μm one-poly six-metal (1P6M) complementary metal-oxide semiconductor (CMOS) as system-on-chip, comprising:

a voltage controlled oscillator;

a buffer amplifier coupled to said voltage controlled oscillator;

a power divider coupled to said buffer amplifier;

a first driving amplifier and a second driving amplifier respectively coupled to said power divider at a first end and a second end thereof;

a mixer coupled to said first driving amplifier; and a low-noise amplifier coupled to said mixer, wherein said voltage controlled oscillator, said buffer amplifier, said power divider, said first and second driving amplifiers, said mixer and said low-noise amplifier are integrated into the chip;

a receiving antenna array and a transmitting antenna array, wherein said receiving antenna array and said transmitting antenna array are isolated by a value of at least 40 dB, and the receiving antenna array receives a microwave signal having a signal-to-noise ratio reflecting from a target where said signal-to-noise ratio being varied from 28 dB to 34 dB corresponding to the multiple lanes, and the antenna arrays being configured at a position for the receive antenna array to receive said microwave signal at an elevation angle and being spaced from each other at a distance of less than 5 mm and coupled to said signal input and said signal output respectively;

an adjusting device coupled to said receiving antenna array and said transmitting antenna array for adjusting one of said position and said elevation angle to achieve the signal-to-noise ratio; and an intermediate-frequency and digital signal processing unit for a real assessment of range measurement coupled to said radio-frequency transceiving unit and generating at least a traffic parameter corresponding to at least a lane in response to a difference-frequency signal of the radio-frequency transceiving unit, wherein said traffic parameter being one selected from a group consisting of a vehicle speed, a vehicle classification, an occupancy, a density and a flow; thereby said microwave vehicle detecting apparatus being operable for multi-lane vehicle detection.

* * * * *